US011572612B2

(12) United States Patent
Won et al.

(10) Patent No.: US 11,572,612 B2
(45) Date of Patent: Feb. 7, 2023

(54) HIGH-ENTROPY ALLOY, AND METHOD FOR PRODUCING THE SAME

(71) Applicant: KOREA INSTITUTE OF MACHINERY & MATERIALS, Daejeon (KR)

(72) Inventors: Jong Woo Won, Changwon-si (KR); Young Sang Na, Changwon-si (KR); Ka Ram Lim, Changwon-si (KR)

(73) Assignee: KOREA INSTITUTE OF MATERIALS SCIENCE, Changwon-si (KR)

( * ) Notice: Subject to any disclaimer, the term of this patent is extended or adjusted under 35 U.S.C. 154(b) by 56 days.

(21) Appl. No.: 16/771,934

(22) PCT Filed: Nov. 30, 2018

(86) PCT No.: PCT/KR2018/015096
§ 371 (c)(1),
(2) Date: Jun. 11, 2020

(87) PCT Pub. No.: WO2019/117519
PCT Pub. Date: Jun. 20, 2019

(65) Prior Publication Data

US 2020/0392613 A1 Dec. 17, 2020

(30) Foreign Application Priority Data

Dec. 11, 2017 (KR) ..... 10-2017-0169171
Dec. 11, 2017 (KR) ..... 10-2017-0169172

(51) Int. Cl.
*C22F 1/16* (2006.01)
*B21B 1/16* (2006.01)
(Continued)

(52) U.S. Cl.
CPC ..... *C22F 1/16* (2013.01); *B21B 1/16* (2013.01); *B21B 3/00* (2013.01); *C22C 30/00* (2013.01)

(58) Field of Classification Search
CPC ..... C22F 1/16; B21B 1/16; B21B 3/00; C22C 30/00
See application file for complete search history.

(56) References Cited

U.S. PATENT DOCUMENTS 10,364,487 B2 * 7/2019 Park ..... C22F 1/11
2014/0150934 A1 6/2014 Lee et al.
(Continued)

FOREIGN PATENT DOCUMENTS

KR 10-1325317 B1 11/2013
KR 10-1748836 B1 7/2017
(Continued)

OTHER PUBLICATIONS

Stepanov et al., "Effect of cryo-deformation on structure and properties of CoCrFeNiMn high-entropy alloy," Intermetallics 59 (2015) pp. 8-17. (Year: 2015).*
(Continued)

*Primary Examiner* — John A Hevey
(74) *Attorney, Agent, or Firm* — Hauptman Ham, LLP

(57) ABSTRACT

A high-entropy alloy having ultra-high strength and high hydrogen embrittlement resistance due to formation of a microstructure at a low strain may be produced without a severe plastic deformation.
A method for producing the high-entropy alloy includes (a) annealing and homogenizing an initial alloy material at 1000 to 1200° C. for 1 to 24 hours; and (b) rolling the annealed and homogenized initial alloy material into a rod, at a cryogenic temperature of −100 to −200° C. while pressing the initial alloy material in multi-axial directions at a strain
(Continued)

of 0.4 to 1.2, thereby to produce the high-entropy alloy having intersecting twins as a microstructure, and secondary fine twins formed in the intersecting twins, wherein the initial alloy material contains Co of 5 to 35%, Cr of 5 to 35%, Fe of 5 to 35%, Mn of 5 to 35%, and Ni of 5 to 35%, based on weight %.

5 Claims, 18 Drawing Sheets

(51) Int. Cl.
*B21B 3/00* (2006.01)
*C22C 30/00* (2006.01)

(56) References Cited

U.S. PATENT DOCUMENTS

2017/0268090 A1 9/2017 Kim et al.
2019/0055630 A1 2/2019 Lee et al.
2021/0054486 A1* 2/2021 Kim ..... C22C 38/40

FOREIGN PATENT DOCUMENTS

KR 10-2017-0110019 A 10/2017
KR 10-2017-0110284 A 10/2017
KR 10-2018-0102309 A 9/2018

OTHER PUBLICATIONS

Stepanov et al., "Microstructure Refinement in the CoCrFeNiMn High Entropy Alloy under Plastic Straining," Materials Science Forum, vol. 879, Published Nov. 15, 2016, pp. 1853-1858. (Year: 2016).*

International Search Report dated Mar. 15, 2019, in connection with corresponding International Patent Application No. PCT/KR2018/015096.

Bernd Gludovatz et al., "A fracture-resistant high-entropy alloy for cryogenic applications". Science, Sep. 5, 2014, vol. 345, Issue 6201, pp. 1153-1158.

Jongun Moon et. al., "On the strain rate-dependent deformation mechanism of CoCrFeMnNi high-entropy alloy at liquid nitrogen temperature", May 15, 2017, Materials Research Letters, vol. 5, No. 7, pp. 472-477.

Minju Kang et al., "Microstructure and Mechanical Properties of As-cast CoCrFeMnNi High Entropy Alloy", KJMM 2017. Oct. 2017, vol. 55, No. 10., pp. 732-738.

Hong Luo et.al., "Hydrogen enhances strength and ductility of an equiatomic high-entropy alloy", Scienctific Reports, Aug. 29, 2017, vol. 7, Article No. 9892.

* cited by examiner

【FIG. 1】
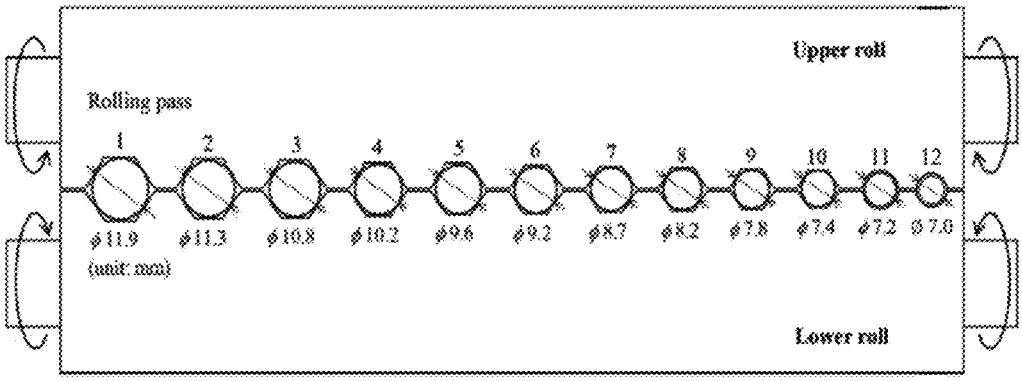

【FIG. 2A】
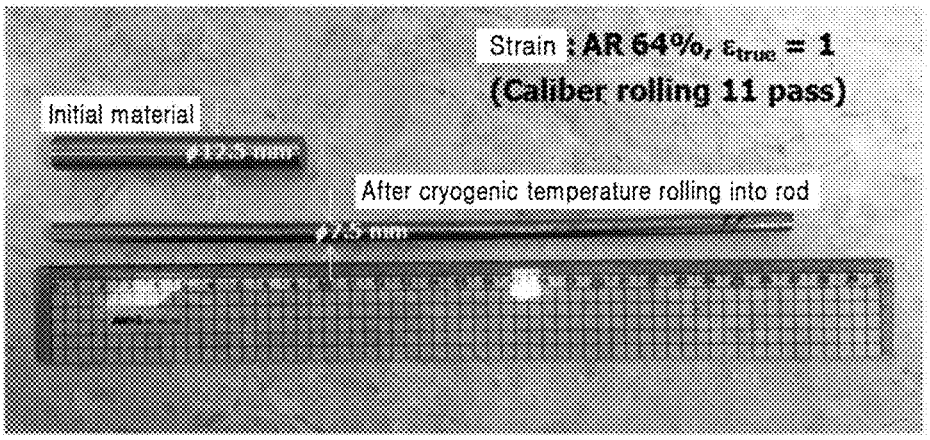
【FIG. 2B】
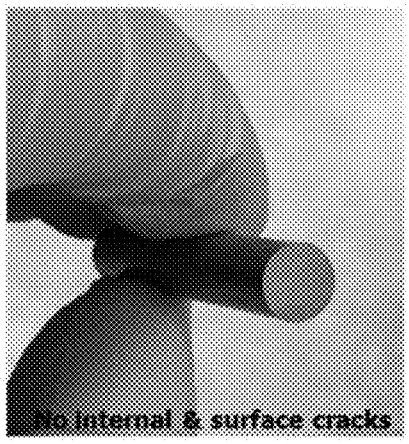

【FIG. 3】
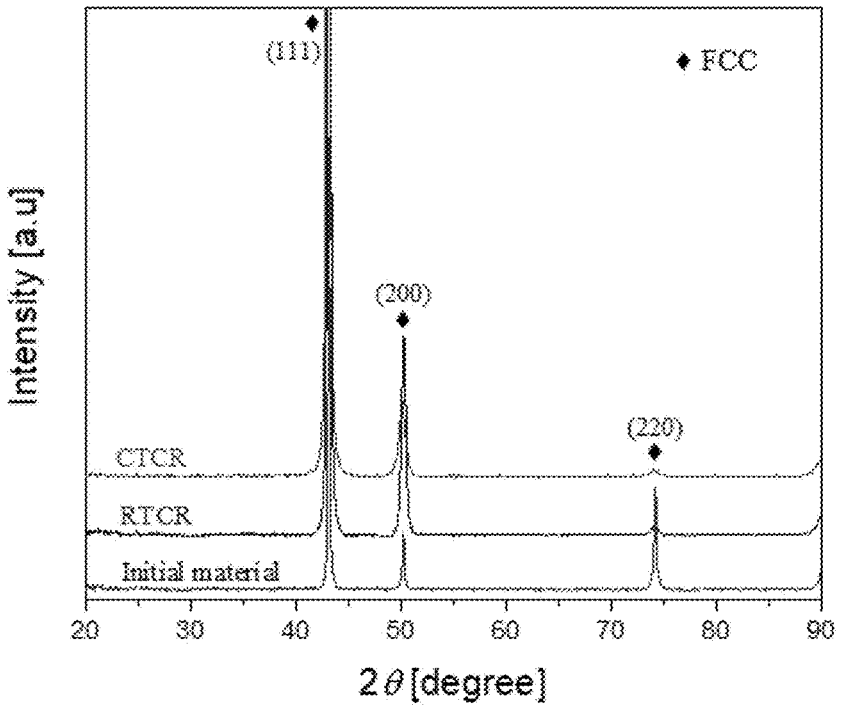

【FIG. 4】
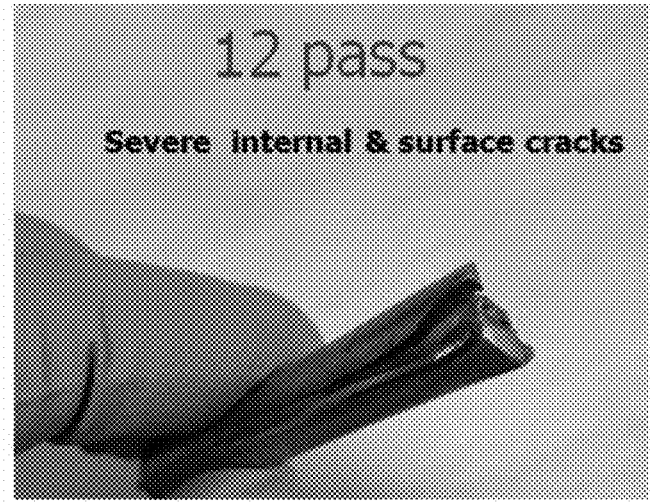

【FIG. 5A】
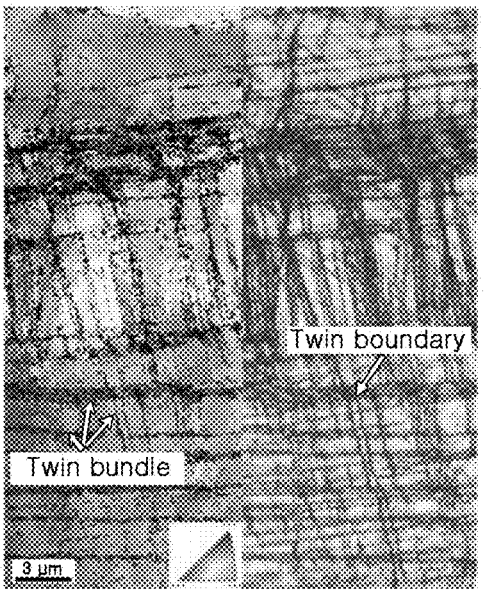

【FIG. 5B】
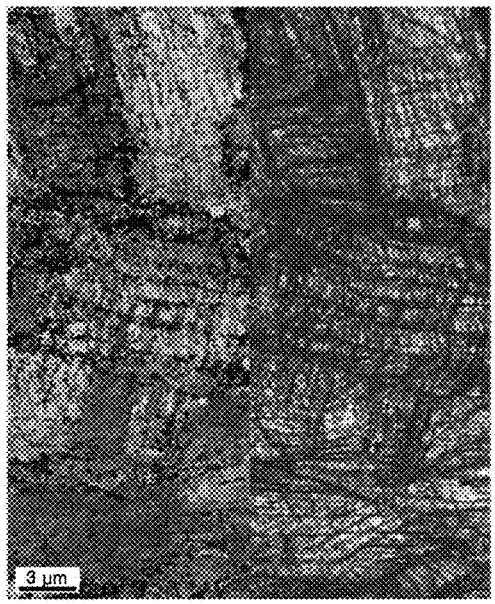

【FIG. 6A】
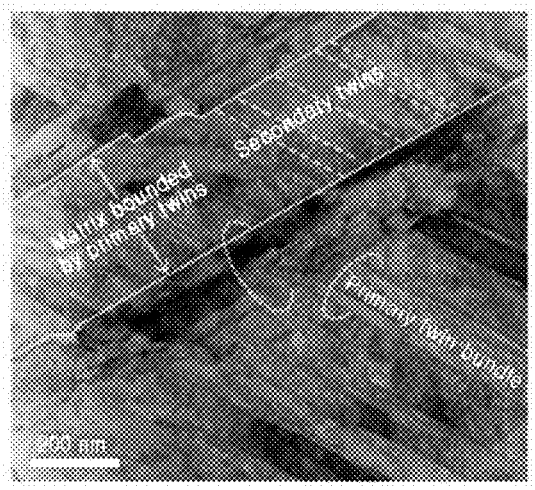
【FIG. 6B】
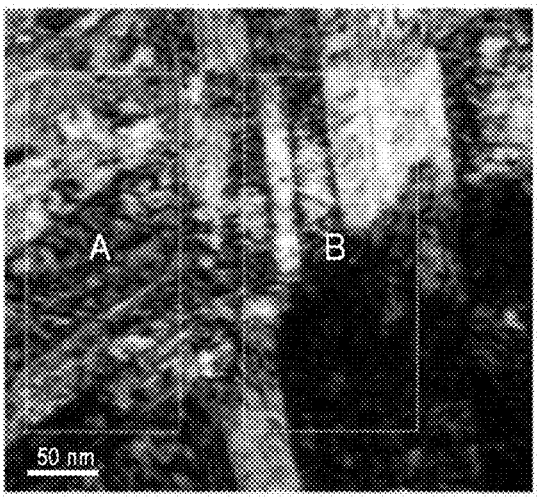

【FIG. 6C】
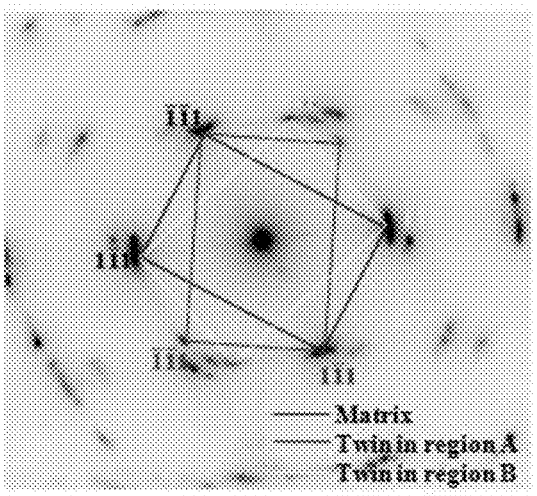
【FIG. 6D】
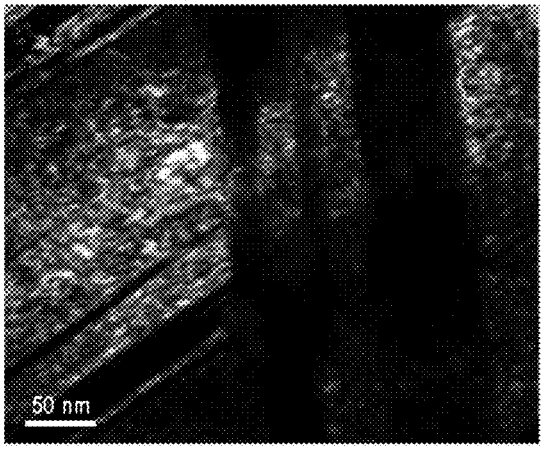

【FIG. 6E】
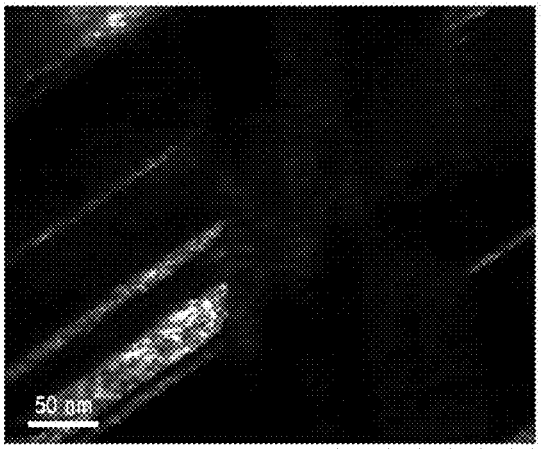
【FIG. 6F】
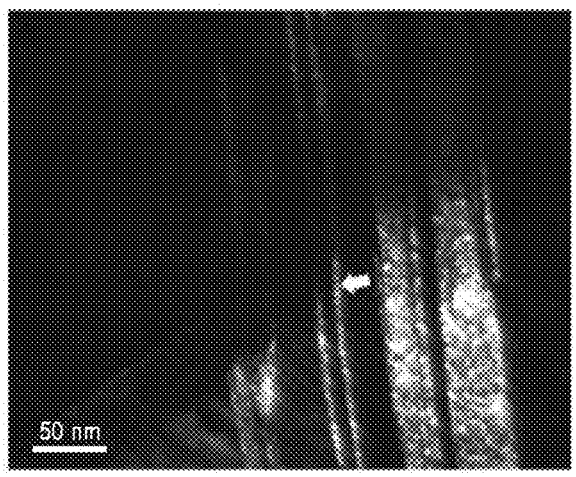

【FIG. 7】
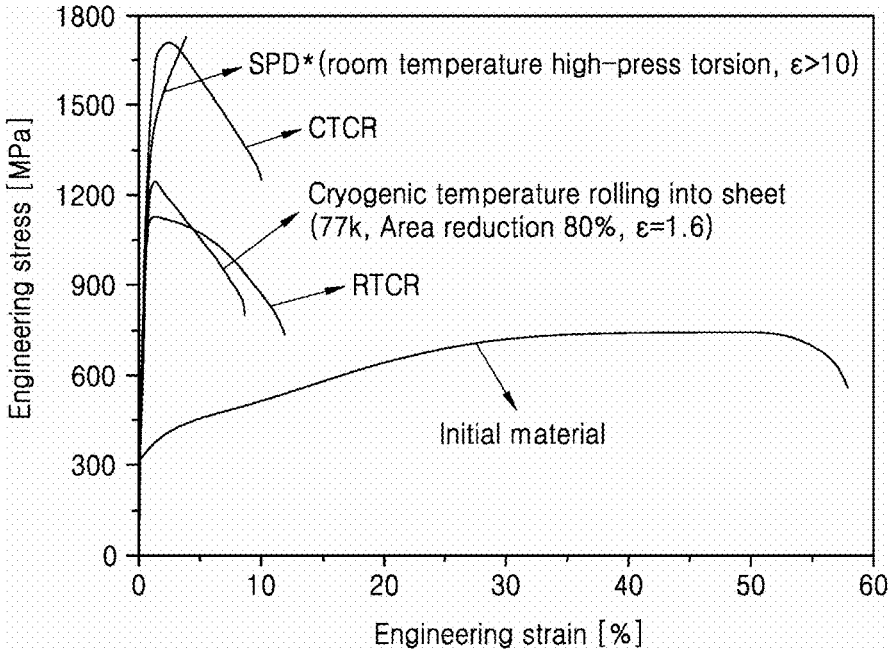

【FIG. 8】
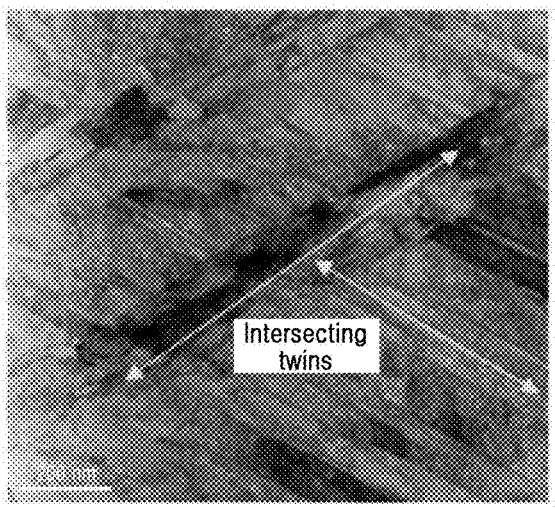
【FIG. 9】
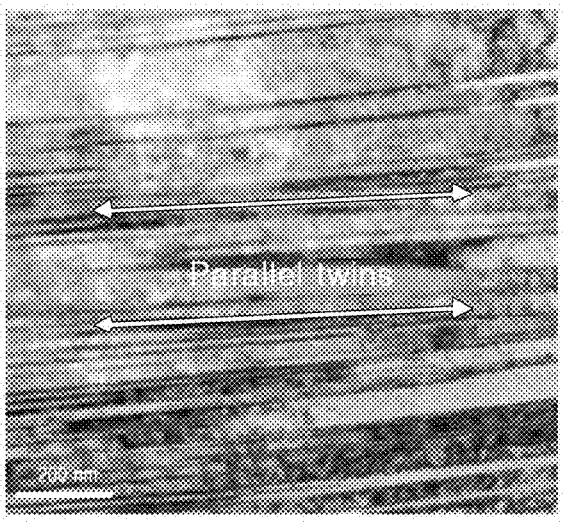

【FIG. 10A】
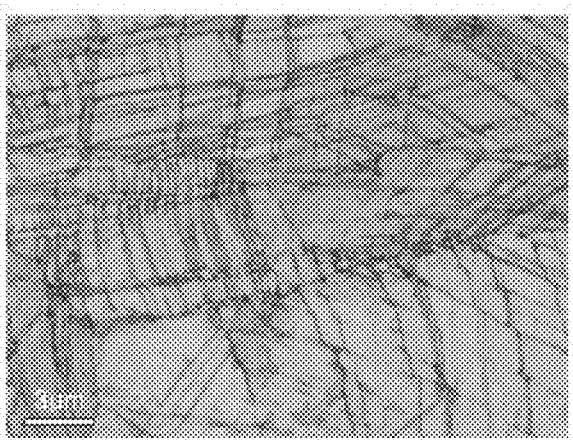
【FIG. 10B】
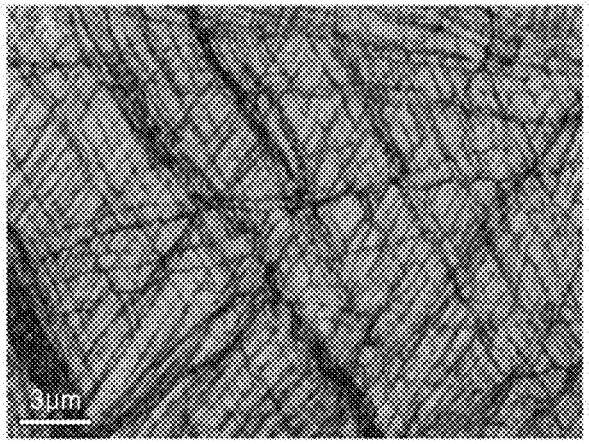

【FIG. 10C】
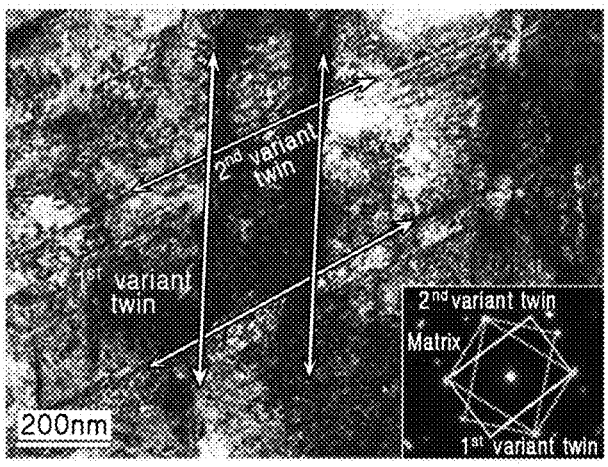

【FIG. 11】
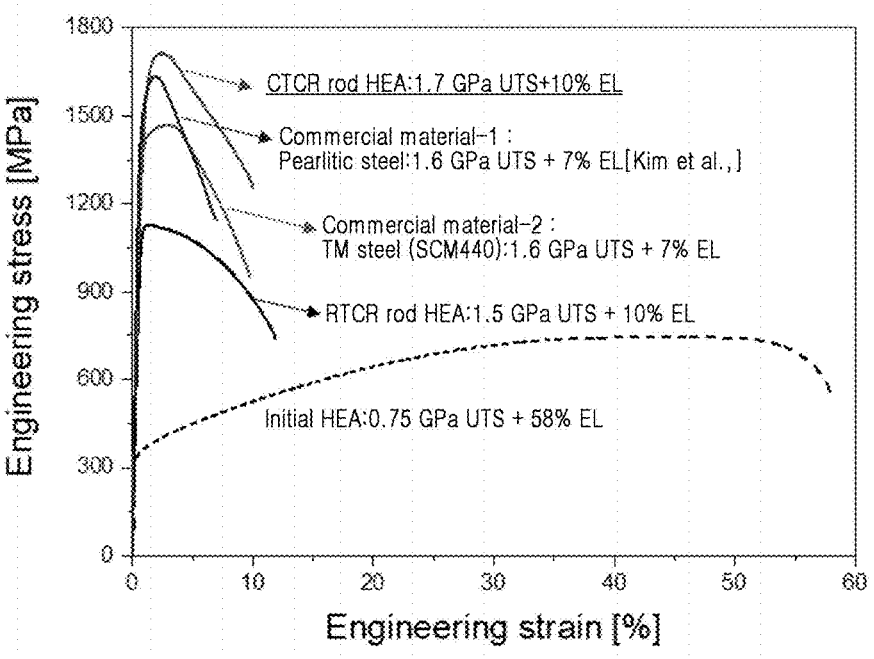

【FIG. 12】
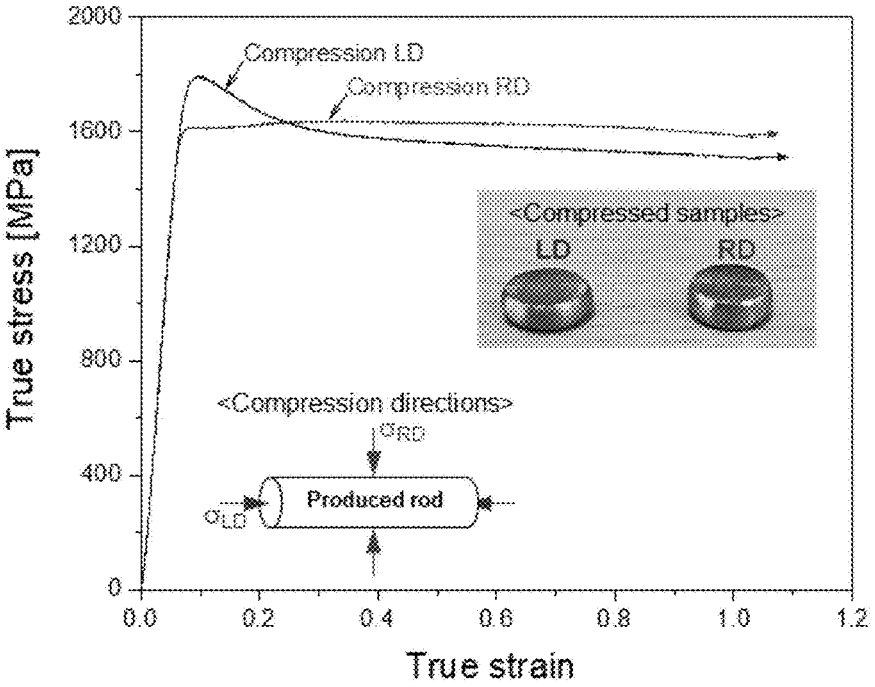
【FIG. 13】
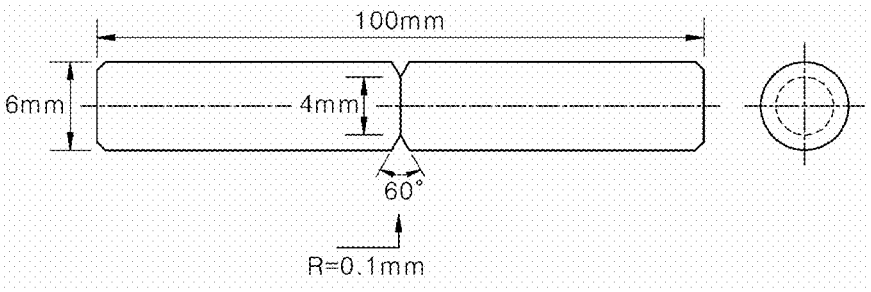

【FIG. 14】
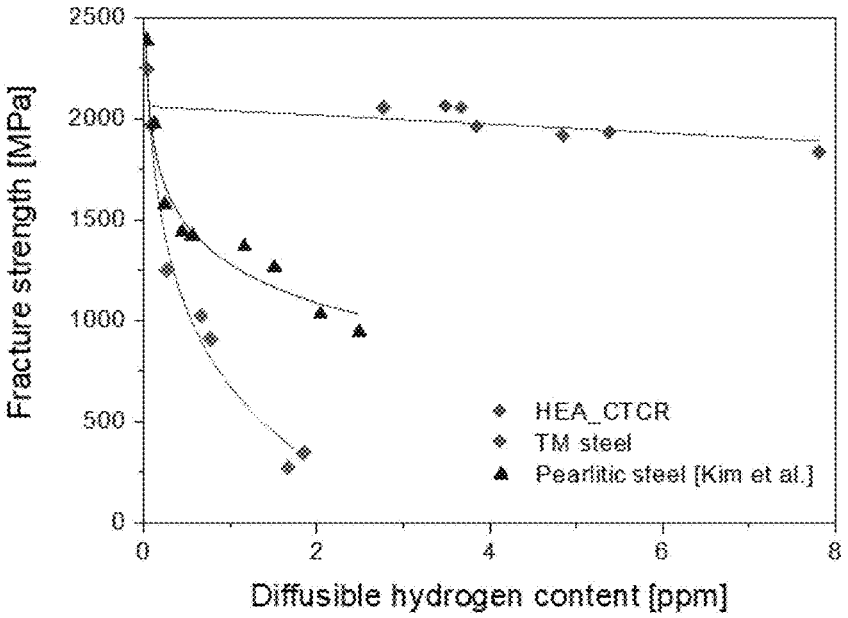

【FIG. 15A】
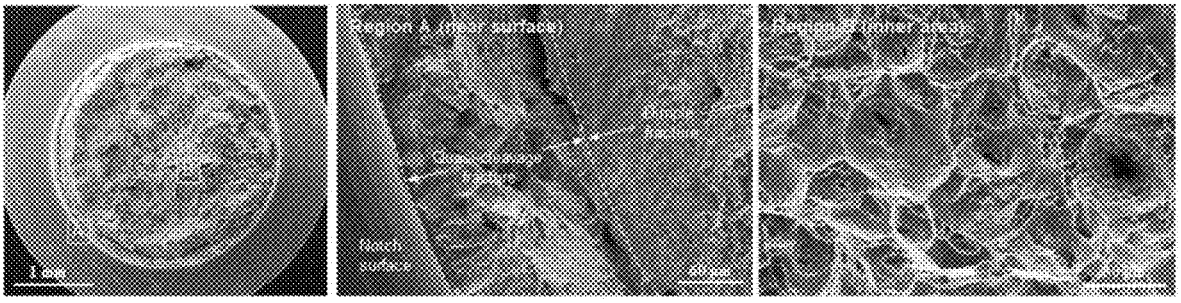
【FIG. 15B】
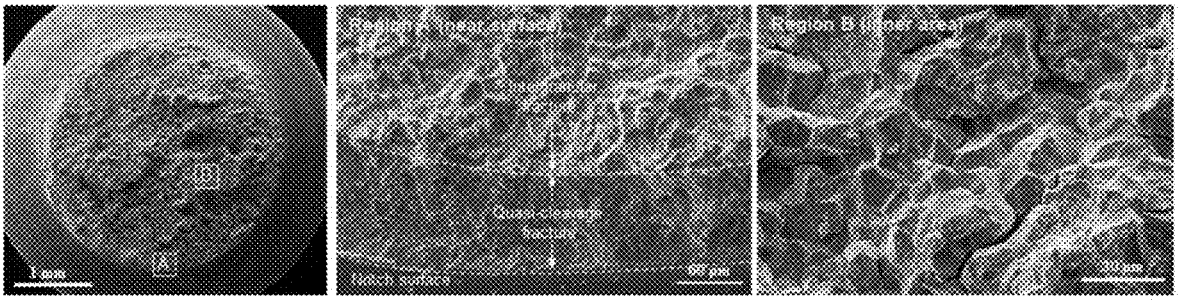

【FIG. 16A】
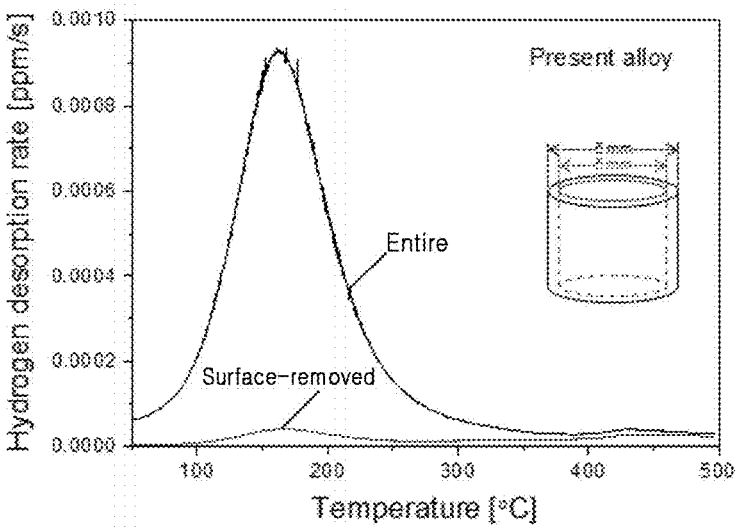
【FIG. 16B】
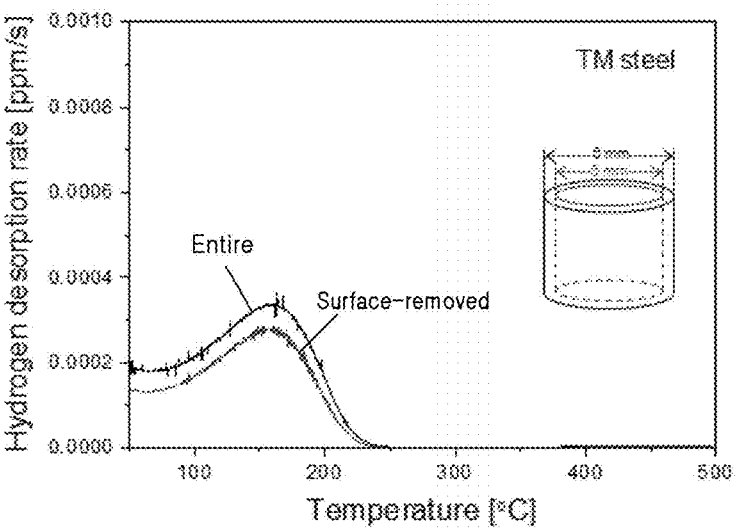

HIGH-ENTROPY ALLOY, AND METHOD FOR PRODUCING THE SAME

CROSS REFERENCE TO RELATED APPLICATION

The present application is a national stage filing under 35 U.S.C § 371 of PCT application number PCT/KR2018/015096 filed on Nov. 30, 2018 which is based upon and claims the benefit of priorities to Korean Patent Application No. 10-2017-0169171, filed on Dec. 11, 2017 and Korean Patent Application No. 10-2017-0169172, filed on Dec. 11, 2017 in the Korean Intellectual Property Office, and which are incorporated herein in their entireties by reference.

FIELD

The present disclosure relates to a high-entropy alloy and a method for producing the same, in which cryogenic temperature rolling is conducted at a low strain, thereby to obtain nano-grains, such that the alloy has both of ultrahigh strength and excellent hydrogen embrittlement resistance.

DESCRIPTION OF RELATED ART

A high-entropy alloy (HEA) is a crystalline alloy containing five or more elements as main elements, and does not have a brittleness even in an intermediate composition. The high-entropy alloy is based on a face-centered cubic (FCC) crystal structure in which particles are positioned at centers of faces of a regular cube, or a body-centered cubic (BCC) crystal structure in which particles are positioned at vertices and centers of the cube.

In the high-entropy alloy, entropy is maximized compared to mixed enthalpy. Specifically, the maximized entropy stabilizes a single phase of the face-centered cubic structure and realizes excellent impact absorbing ability in a low temperature. The high-entropy alloy has large lattice deformation, such that solid solution enhancing effect is large. Further, in the high-entropy alloy, diffusion may be difficult, thereby to form a nano-precipitation phase with reduced growth. The high-entropy may increase the stability of the microstructure.

It has been reported that the FCC structure-based high-entropy alloy has improved strength and toughness at a cryogenic temperature compared to those in a room temperature, and is out of a banana curve as a relationship between strength and elongation. Further, the FCC structure-based high-entropy alloy is highly industrially applicable.

However, the FCC-structured high-entropy alloy is basically low in strength (0.2 to 0.4 GPa). In general, in order to increase a strength of a metal material, the material may be hardened via a general plastic working method such as rolling and extrusion. However, this scheme may not increase the strength thereof to about 1 GPa.

When a FCC grain is ultra-fine (<1 μm), the strength may be increased to 1 GPa or greater. However, for this purpose, a special working method (that is, severe plastic deformation (SPD)) capable of applying a large plastic working amount is required. The SPD includes ECAP (Equal Channel Angular Pressing) and HPT (High-Pressure Torsion). However, those methods are not only limited in terms of a size or a shape of a specimen that may be manufactured using the methods, but also has low production efficiency. Therefore, it is impossible to produce a high-strength material having high practicality using the SPD.

On the other hand, hydrogen embrittlement resistance is a very important property of the high strength material. This is because the hydrogen embrittlement is accelerated in the high-strength material. In particular, it is known that when a strength is 1 GPa or greater, a hydrogen delayed fracture resistance is significantly reduced. This is because as the strength of the material increases, the number of diffusible trapping sites increases due to an increase in dislocation density in the material and an increase in grain boundary density due to grain refinement. This problem has become a major obstacle to development of ultra-high strength metal materials. When the material with the ultra-high strength and the high hydrogen embrittlement resistance are developed, engineering advantages may be secured in bolts or hydrogen pipes, where above two properties are required. For example, when the strength of the material is increased, a small diameter bolt may be produced. In addition, when the strength of the material is increased, the hydrogen piping may be thinner, so that weight reduction and material saving may be secured simultaneously.

Accordingly, there is a need for a method for producing a material having ultra-high strength and high hydrogen delayed fracture resistance using a general working method without using the SPD.

DISCLOSURE

Technical Purposes

A purpose of the present disclosure is to provide a method for production of an ultrahigh strength high-entropy alloy having a nanostructure under low strain and cryogenic temperature rolling conditions and without severe plastic deformation.

Further, a purpose of the present disclosure is to provide a high-entropy alloy having both of ultrahigh strength and high hydrogen delayed fracture resistance.

Technical Solutions

A method for producing a high-entropy alloy to achieve the purpose of the present disclosure includes (a) annealing and homogenizing an initial alloy material at 1000 to 1200° C. for 1 to 24 hours; and (b) rolling the annealed and homogenized initial alloy material into a rod, thereby to produce a high-entropy alloy having intersecting twins as a microstructure, and secondary fine twins formed in the intersecting twins, wherein the initial alloy material contains Co of 5 to 35%, Cr of 5 to 35%, Fe of 5 to 35%, Mn of 5 to 35%, and Ni of 5 to 35%, based on weight %.

A high-entropy alloy to achieve the purpose of the present disclosure contains Co of 5 to 35%, Cr of 5 to 35%, Fe of 5 to 35%, Mn of 5 to 35%, and Ni of 5 to 35%, based on weight %, wherein the alloy has intersecting twins as a microstructure.

Technical Effects

The production method of the high-entropy alloy according to the present disclosure may use the rolling process of the initial material into the rod at the cryogenic temperature while applying the pressure in multi-axis directions. This may improve the twin activation to effectively segment the grains to promote the refinement of the alloy.

The high-entropy alloy according to the present disclosure has nano-grains as microstructure at the low strain without the severe plastic deformation, and thus, may have excellent productivity and may exhibit ultrahigh strength properties. Further, the high-entropy alloy as produced via the rolling into the rod at the cryogenic temperature may have improved strength and elongation compared to those in the room temperature rolling or in the severe plastic deformation (SPD), and, thus, it is suitable as a material used in extreme environments such as cryogenic temperature environments.

The high-entropy alloy according to the present disclosure may have maximized grain refinement by the twins effectively segmenting the grains. Accordingly, the alloy may exhibit high strength characteristics.

In particular, the high-entropy alloy according to the present disclosure exhibits a higher hydrogen delayed fracture resistance because the twin lines have much higher fracture resistance than the grain boundaries have. Another important factor determining the hydrogen embrittlement is the ability of the hydrogen to diffuse inside the material. When the hydrogen moves quickly inside the material, the concentration of hydrogen increases at the cracking site, thus accelerating the hydrogen embrittlement. However, an outstanding feature of the high-entropy alloy in accordance with the present disclosure has sluggish diffusion, which suppresses these factors to further improve the hydrogen embrittlement resistance.

BRIEF DESCRIPTION OF DRAWINGS

FIG. 1 is a schematic diagram of a multi-pass caliber roller according to the present disclosure.

FIG. 2A is a photo comparing an initial alloy material with a high-entropy alloy after cryogenic temperature rolling (condition: −196.15° C., area reduction 64%, 11 passes, strain 1) of the initial alloy material into a rod, according to the present disclosure. FIG. 2B is a cross-sectional view of the high-entropy alloy as set forth in FIG. 2A.

FIG. 3 shows XRD pattern results of an initial alloy material, RTCR material, and CTCR material.

FIG. 4 is a photo of a high-entropy alloy after cryogenic temperature rolling (condition: −196.15° C., area reduction 75%, 12 passes, strain 1.4) of an initial alloy material into a rod according to the present disclosure.

FIG. 5A shows a EBSD IPF (inverse pole figure) map (left) and an image quality (IQ) map (right) of a RTCR material. FIG. 5B shows a EBSD IPF (inverse pole figure) map (left) and an image quality (IQ) map (right) of a CTCR material.

FIG. 6A to FIG. 6F shows the results of TEM analysis of CTCR material ((FIG. 6A) TEM, (FIG. 6B) BF image, (FIG. 6C) DF, (FIG. 6D) DF image at matrix, (FIG. 6E) DF image at twin A, and (FIG. 6F) DF image at twin B).

FIG. 7 shows results of elongation and yield strength of each of an initial alloy material, RTCR material, CTCR material, severe plasticly deformed (SPD) (high press torsion, strain>10) material, and a sheet obtained by cryogenic temperature rolling (sheet rolling, −196.15° C., area reduction 80%, strain 1.6).

FIG. 8 shows a microstructure of the high-entropy alloy of FIG. 7 obtained by the cryogenic temperature rolling into a rod (CTCR).

FIG. 9 is a microstructure of the high-entropy alloy of FIG. 7 obtained by the cryogenic temperature rolling into a sheet.

FIG. 10A to FIG. 10C show a microstructure of a produced rod. FIG. 10A shows a EBSD band contrast map picture of a RTCR rod. FIG. 10B shows a EBSD band contrast map picture of a CTCR rod (b). FIG. 10C shows a TEM bright field image (BF) of the CTCR rod.

FIG. 11 shows results of elongation and tensile strength of each of an initial alloy material, RTCR rod, CTCR rod, TM steel rod as a conventional ultrahigh strength commercial material, and pearlitic steel rod as a conventional ultrahigh strength commercial material.

FIG. 12 shows a results showing a true stress based on a true strain of CTCR rod and a compressed sample thereof.

FIG. 13 is a cross-sectional view of a notched rod specimen.

FIG. 14 shows results of notch fracture stress based on diffusible hydrogen contents after notching each of a CTCR rod, a TM steel rod as a conventional ultrahigh strength commercial material, and a pearlitic steel rod as a conventional ultrahigh strength commercial material.

FIG. 15A shows an observation result of a fracture surface when a slow strain tensile test is performed on a specimen of a CTCR rod which is notched and then into which hydrogen is injected at a current density of 10 $Am^{-2}$ for 24 hours at 96.85° C. in 3% NaCl+0.3% $NH_4SCN$ aqueous solution. FIG. 15B shows an observation result of a fracture surface when a slow strain tensile test is performed on a specimen of a TM steel rod which is notched and then into which hydrogen is injected at a current density of 70 $Am^{-2}$ for 48 hours at 25° C. in 0.1 M NaOH aqueous solution.

FIG. 16A and FIG. 16B shows results of thermal desorption spectroscopy (TDS) analysis after hydrogen is injected into a CTCR rod (left) and a TM steel rod (right) under the same condition.

DETAILED DESCRIPTIONS

Advantages and features of the present disclosure and a method to achieve them will become apparent by referring to embodiments described below in detail together with the accompanying drawings. However, the present disclosure is not limited to the embodiments disclosed below, but will be implemented in various different forms. Only these embodiments are provided to allow the present disclosure to be complete, and to completely inform the skilled person to the art of a scope of the present disclosure. The present disclosure is only defined by the scope of the claims. The same reference numerals refer to the same components herein.

Hereinafter, a high-entropy alloy and a production method thereof according to a preferred embodiment of the present disclosure will be described in detail with reference to the accompanying drawings.

The present disclosure relates to a high-entropy alloy having a nano-grain at low strain without severe plastic deformation, thereby exhibiting ultrahigh strength and high elongation characteristics, and to a production method thereof.

The production method of the high-entropy alloy according to the present disclosure includes annealing and homogenizing an initial alloy material (S110) and rolling the annealed alloy material using a multi-pass caliber roller (S120).

Annealing and Homogenizing Initial Alloy Material (S110)

The initial alloy material is in an as-cast state as a first worked state. A microstructure of the initial alloy material has a coarse columnar structure (grain size <300 μm) of a cubic system. The cubic system has three virtual axes orthogonal to each other and passing through a center of a crystal and has the same side length.

In order to remove fine segregation of Mn from the initial alloy material, the annealing is preferably performed at 1000 to 1200° C. for 1 to 24 hours.

In general, the presence of the Mn segregation locally weakens stability of the FCC, thereby causing ferrite precipitation or martensitic transformation at grain boundaries during deformation. This secondary phase and FCC phase interface promotes cracking during deformation. Further, the Mn fine segregation lowers deformation homogeneity of a matrix, thereby to reduce ductility. This phenomenon occurs during solidification of the alloy because a melting temperature of Mn is relatively low.

Therefore, it is preferable to perform the annealing and homogenizing at 1000 to 1200° C. for 1 to 24 hours to remove the Mn fine segregation in order to secure excellent workability of the material.

The initial alloy material contains Co: 5 to 35%, Cr: 5 to 35%, Fe: 5 to 35%, Mn: 5 to 35%, and Ni: 5 to 35% based on weight %. The initial alloy material may further contain a trace of impurities.

When the above composition range of the high-entropy alloy is not satisfied, it is difficult to obtain a solid solution having an FCC single phase. Thus, it is preferable to satisfy the composition range as indicated above.

Rolling Annealed Material using Multi-Pass Caliber Roller (S120)

Subsequently, the annealed and homogenized initial alloy material may be subjected to rolling into a rod. Thus, the high-entropy alloy having intersecting twins as a microstructure, and secondary fine twins formed inside the intersecting twins may be produced.

As shown in FIG. 1, it is preferable to perform rolling, preferably, based on 6 to 11 passes, more preferably, 8 to 11 passes, using a caliber roller having a circular caliber, thereby to obtain a rod. When performing the rolling based on at least 6 passes to obtain the rod, a high yield strength of 1 GPa or greater may be secured. However, when performing the rolling based on 12 or more passes to obtain the rod, cracks may occur in the rod and thus a sound rod may not be realized.

The multi-pass caliber roller has 12 circular holes with different diameters defined in a boundary region between an upper roller and an lower roller. In this connection, a diameter of a circular hole at a position #1 is 11.9 mm, a diameter of a circular hole at a position #2 is 11.3 mm, a diameter of a circular hole at a position #11 is 7.2 mm, and a diameter of a circular hole at a last position #12 is 7.0 mm In this manner, it is preferable that a size of the caliber gradually decreases from the size of the first caliber as the caliber number increases in a direction in which the initial alloy material moves. As the initial alloy material passes through the circular holes of different diameters, compressive stress occurs in all directions of an circular array, that is, in multi-axes directions. Accordingly, the intersecting twins may be formed in the high-entropy alloy.

Further, when using the multi-pass caliber roller, it is preferable to perform the rolling into a rod under the condition that a maximum area reduction (AR) is 64% and a total strain is 0.4 to 1.2 at a cryogenic temperature of −100 to −200° C. For example, the area reduction may be in a range of 40 to 64%, and the total strain may be in a range of 0.43 to 1.02. The area reduction (%) may refer to a difference between diameters of the material before and after rolling, and may be equal to an reduction of an cross sectional area (%). The total strain may be calculated as ln(initial specimen cross sectional area/post-deformation cross sectional area).

As the rolling into the rod according to the present disclosure is performed under the above condition, the intersecting twins are formed as the microstructure of the alloy, thereby effectively segmenting the grains. The intersecting twins are formed of primary twins, and the secondary fine twins are formed inside the intersecting twin lines. Because, at the cryogenic temperature, the twin is more active, the secondary fine twins which may not be formed in a general condition may occur. When the secondary fine twin occurs inside the line of the intersecting twins, the microstructure becomes finer. An average size of the fine grain due to the twins may be in a range of 30 to 150 nm, preferably, in a range of 50 to 100 nm.

Thus, the cryogenic temperature rolling using the caliber roller may improve activation of the twins and maximizing the effect of the grain refinement, thereby to achieve the ultrahigh strength of the alloy.

A reason why the microstructure is formed in the alloy in accordance with the present disclosure is that the rolling into the rod according to the present disclosure causes the multi-axial deformation, so that the intersecting twins are generated, whereas a conventional rolling is two-axis rolling and thus deformation occurs in one direction, so that the twin is formed in only one direction.

Thus, the high-entropy alloy having the intersecting twins as the microstructure and the secondary fine twins formed therein may be produced as a bulk rod alloy without defects on a surface and therein. Further, the high-entropy alloy may have a single-phase structure of FCC.

The high-entropy alloy according to the present disclosure contains Co: 5 to 35%, Cr: 5 to 35%, Fe: 5 to 35%, Mn: 5 to 35%, and Ni: 5 to 35% based on weight %, and has intersecting twins as a microstructure.

As described above in the production method, the intersecting twins may include a remarkably thin secondary fine twin formed inside the line of the intersecting twins. An average size of the fine grain due to the secondary fine twin may be in a range of 30 to 150 nm.

The high-entropy alloy may have a single-phase structure of FCC (Face Centered Cubic). Thus, the high-entropy alloy has a yield strength of 1500 MPa or higher and has elongation of 8% or greater at room temperature (25±5° C.).

Therefore, the high-entropy alloy according to the present disclosure may have ultrahigh strength at low strain.

In FIG. 2A, and FIG. 2B to FIG. 9, the initial alloy material was produced as follows.

An initial alloy material having a composition of $Co_{20}Cr_{20}Fe_{20}Mn_{20}Ni_{20}$ ($Co_{19.97}Cr_{20.43}Fe_{19.78}Mn_{19.54}Ni_{20.28}$) was produced. Subsequently, the initial alloy material was subjected to annealing and homogenizing at 1100° C. for 24 hours. Subsequently, in order to maintain the cryogenic temperature during the rolling into the rod at cryogenic temperature, the annealed initial alloy material was immersed in liquid nitrogen for about 10 minutes. Then, the rolling into the rod was performed at cryogenic temperature.

In FIG. 2A, and FIG. 2B to FIG. 9, RTCR material refers to an alloy that is rolled into a rod at 25° C. and in a rolling condition: an area reduction of 64%, 11 passes, and strain 1. CTCR material refers to an alloy that is rolled into a rod under a rolling condition: 64% area reduction, 11 passes, and strain 1 and at −196.15° C.

The compositional analysis was measured with an energy dispersive spectrometer mounted on a scanning electron microscope (7100F, JEOL).

Tensile properties were evaluated in a deformation rate of $10^{-3}$ $s^{-1}$ and at room temperature. A test piece used for the tensile test has a gauge length of 10 mm, and has a diameter of 2.5 mm (ASTM-E8). The tensile test piece was machined from a core of the produced rod. The microstructure was evaluated using electron backscatter diffraction measurement (EBSD, model: Helios NanoLab™ 600, FEI) under conditions of an acceleration voltage of 15 kV and a step size of 50 nm. A viewing direction is perpendicular to a longitudinal direction of the material. Further, the microstructure was evaluated by an electron microscope (TEM, model: JEM 2100F, JEOL) operating at an acceleration voltage of 200 kV. TEM samples were prepared by focused ion beam (model: Quanta 3D FEG, FEI). A crystal structure of the alloy was measured based on X-ray diffraction (XRD) measurement using an MXP21VAHF diffractometer with CuKα radiation (model: D/Max-2500VL/PC, RIGAKU).

FIG. 2A is a photo comparing an initial alloy material with a high-entropy alloy after cryogenic temperature rolling (condition: −196.15° C., area reduction 64%, 11 passes, strain 1) of the initial alloy material into a rod, according to the present disclosure. FIG. 2B is a cross-sectional view of the high-entropy alloy as set forth in FIG. 2A.

Referring to FIG. 2A and FIG. 2B, the cryogenic temperature rolling was conducted to convert a cylindrical initial alloy material having a diameter of 12.5 mm into a bulk rod alloy having a diameter of 7.5 mm and a length of 300 mm. FIG. 2B shows that a sound rod with good straightness and no cracks on a surface and therein was produced.

FIG. 3 shows the XRD pattern results of the initial alloy material, the RTCR material, and the CTCR material. The XRD pattern shows that only FCC phase peaks indicating that the initial alloy material has only the FCC single phase were detected.

FIG. 4 is a photo of a high-entropy alloy after cryogenic temperature rolling (condition: −196.15° C., area reduction 75%, 12 passes, strain 1.4) of an initial alloy material into a rod according to the present disclosure. The photo shows that as the rod rolling condition is 12 passes, cracks occurred on the surface and therein. This means that when rolling the initial alloy material into a rod, it is desirable to provide a work amount: 11 passes or smaller, a maximum area reduction of 64%, and a strain of 1 or smaller.

FIG. 5A shows a EBSD IPF (inverse pole figure) map (left) and an image quality (IQ) map (right) of a RTCR material. FIG. 5B shows a EBSD IPF (inverse pole figure) map (left) and an image quality (IQ) map (right) of a CTCR material.

Rolling using the multi-pass caliber significantly changed an initial microstructure. The RTCR material in FIG. 5A has intersecting twin lines which are 100 to 600 nm long. Because the twins are remarkably fine, the IPF map may not clearly identify each twin. However, it may be identified from the IQ map that the twin line is composed of several parallel twin lines. The CTCR material of FIG. 5B has a twin line similar to that of the RTCR material. However, it may be observed that there are substantially more twins in the CTCR material than in the RTCR material. From a result of EBSD, a total length of the twin line per unit area was calculated as 1.07 $\mu m^{-1}$ for RTCR material, and was calculated as 3.69 $\mu m^{-1}$ for the CTCR material.

Thus, the twin formation was maximized at cryogenic temperature compared to room temperature, resulting in increased microstructure segmentation at cryogenic temperature. Further, it may be observed that the secondary fine twin is formed inside the line of intersecting twins such that the grain is refined.

Further, referring to FIG. 5B, a relatively dark gray color indicates presence of high density dislocation. This means that dislocation slip occurred together with the deformed twin during the rod rolling process. Strength enhancement due to dislocation accumulation arises from interactions between dislocations which generate internal stress to interfere with dislocation motion. As the number of dislocations increases, the strength of the alloy increases. In addition to the grain refinement, the high density dislocation is expected to affect the strength enhancement of the alloy material.

FIG. 6A to FIG. 6F shows the results of TEM analysis of CTCR material ((FIG. 6A) TEM, (FIG. 6B) BF image, (FIG. 6C) DF, (FIG. 6D) DF image at matrix, (FIG. 6E) DF image at twin A, and (FIG. 6F) DF image at twin B).

In FIG. 6A, it was observed that the twin lines were formed to form the intersecting twins. Despite a fact that the activation of the twin decreases significantly as the matrix narrows, the secondary fine twin was formed within an interface of the primary twin. In FIG. 6B and FIG. 6C, the diffraction pattern (DP) combined with the dark field image shows that different twin variants of twelve possible twin variants in the face-centered cubic structure are activated, thus causing the intersecting twins.

Referring to FIG. 6D to FIG. 6F, the sheet rolling applies compressive stress only in the direction perpendicular to the sheet plane and mainly activates the twin in a single direction. To the contrary, when using the multi-pass caliber roller, the rolling creates compressive stress in all directions of the circular arrangement, all twin variants may be formed during the CTCR. A size of each secondary twin is 5 to 15 nm and is remarkably fine.

The size of the fine grain due to the second twin was calculated using an intercept method. For example, after drawing multiple lines in any direction, the number of lines that satisfy twin boundaries (TBs) was counted and then a ratio of a line length to the number was calculated. As a result of calculation, the CTCR material showed the size of fine grains up to 93 nm, and the RTCR material showed a fine grain size of up to 711 nm.

In general, a severe plastic deformation (SPD) scheme reduces the size of the microstructure to 100 nm or smaller. In accordance with the present disclosure, it may be seen that the CTCR was used to induce the formation of ultrafine particles with a size of 30 to 150 nm.

FIG. 7 shows results of elongation and yield strength of each of an initial alloy material, RTCR material, CTCR material, severe plasticly deformed (SPD) (high press torsion, strain>10, *H. Sharhmir et al., MSEA 676 (2016) 294-303) material, and a sheet obtained by cryogenic temperature rolling (sheet rolling, −196.15° C., area reduction 80%, strain 1.6).

Referring to FIG. 7, it shows that the yield strength of the CTCR material is significantly increased. The cryogenic temperature rolling process into the rod according to the present disclosure increased the yield strength of the initial alloy material by up to 458%. Thus, the CTCR material showed a remarkably high value of 1548 MPa. In addition, the CTCR material showed moderate break elongation of up to 10%.

The yield strength of CTCR material increased by more than about 500 MPa, compared to the yield strength of RTCR material. This result demonstrates the high efficiency of lowering the alloy deformation temperature to −196.15° C.

Further, the yield strength of CTCR material was higher than that of the severe plastic deformation subjected material (SPD). The break elongation of CTCR material was about 2.5 times higher than that of the severe plastic deformation subjected material (SPD).

Further, the CTCR material showed higher yield strength and break elongation than those of the sheet material obtained by the cryogenic temperature sheet rolling process. These results suggest that the rolling into the rod using the multi-pass caliber roller may obtain superior tensile properties than the cryogenic temperature sheet rolling or severe plastic deformation may obtain.

FIG. 8 shows a microstructure of the high-entropy alloy of FIG. 7 obtained by the cryogenic temperature rolling into a rod (CTCR). FIG. 9 is a microstructure of the high-entropy alloy of FIG. 7 obtained by the cryogenic temperature rolling into a sheet. The CTCR material includes the intersecting twins due to the multi-axial deformation. To the contrary, it may be confirmed that in the cryogenic temperature sheet rolling process, parallel twins are formed because compressive stress is applied only in the direction perpendicular to the sheet such that the deformation occurs in a single direction.

Table 1 below shows the results of specimen properties based on the number of passes in the rolling process into the rod (−196.15° C.).

Reduction of area=((initial specimen cross sectional area)−(post-deformation cross sectional area))/(initial specimen cross sectional area)×100

True strain=ln(initial specimen cross sectional area/post-deformation cross sectional area)

TABLE 1

| Number of passes | Specimen diameter | Reduction of area(%) | True strain | Yield strength (MPa) | Elongation (%) |
|---|---|---|---|---|---|
| 0 (Initial specimen) | 12.5 | 0 | 0.00 | 338 | 58 |
| 3 | 11.5 | 15.4 | 0.17 | 581 | 29 |
| 6 | 10.1 | 34.71 | 0.43 | 997 | 17 |
| 9 | 8.1 | 58.0 | 0.87 | 1401 | 12 |
| 11 | 7.5 | 64.0 | 1.02 | 1548 | 10 |

Referring to Table 1, as a work amount as applied increases, the specimen diameter decreases, and the reduction of the area increases. It may be identified that when performing the rolling based on at least 6 passes to obtain the rod, a high yield strength of approximately 1 GPa may be secured. In particular, the specimen having the work amount of 11 passes has excellent yield strength of 1548 MPa compared to other specimens, and has the elongation of approximately 10%. This may result from the maximized grain refinement, thereby making it easier to achieve the higher strength and the high reduction of area.

Table 2 shows results of calculating a yield strength based on microstructure analysis results on specimens to which a work amount of 11 passes is applied. Table 2 quantitatively shows effects of grain refinement and dislocation accumulation that contribute to improvement of the yield strength.

TABLE 2

| | Calculated strength (MPa) | | | | Measured yield strength |
|---|---|---|---|---|---|
| Process | $\Delta\sigma_G$ | $\Delta\sigma_D$ | $\sigma_{IM}$* | Total | (MPa) |
| RTCR | 237 | 403 | 338 | 983 | 1094 |
| CTCR | 710 | 440 | 338 | 1488 | 1548 |

*The yield stress of the initial material.

Referring to Table 2, in the RTCR material, the increase in the yield strength due to the grain refinement was 237 MPa, and the increase in the yield strength due to the dislocation accumulation was 408 MPa.

In the CTCR material, the increase in the yield strength due to the grain refinement was 710 MPa, and the increase in the yield strength due to the dislocation accumulation was 440 MPa. In the CTCR material, the grain refinement has the greater effect on the yield strength than the dislocation accumulation has. This shows that a large amount of the twins play a crucial role in the further refinement of the grains to achieve the high yield strength.

As described above, in accordance with the present disclosure, the initial alloy material is subjected to the rolling process into the rod at the low strain and cryogenic temperatures, thereby refining the grains via the formation of the intersecting twins, such that the high-entropy alloys with ultrahigh strength and high elongation may be produced.

In addition, the high-entropy alloys has nano-grains at the low strain even without severe plastic deformation. Thus, the rolling process has excellent productivity and is suitable for materials used in extreme environments such as cryogenic temperature.

The present disclosure intends to provide a ultrahigh strength rod which is made of the high-entropy alloy. The ultrahigh strength rod according to the present disclosure exhibits ultrahigh strength characteristics due to the twin lines formed inside the grain to effectively refine the grain.

In particular, the ultrahigh strength rod according to the present disclosure has an excellent hydrogen delayed fracture resistance due to the high fracture resistance of the twin line itself, and thus may be applied to all kinds of rods and tubes irrespective of a shape.

The rod according to the present disclosure contains Co: 5 to 35%, Cr: 5 to 35%, Fe: 5 to 35%, Mn: 5 to 35%, and Ni: 5 to 35% based on weigh t %. The rod may further include a trace of impurities.

The Co, Cr, Fe, Mn, and Ni are as described above in the alloy production method. When the rod does not satisfy the composition range, the rod may not have a single-phase of the FCC structure. Thus, it is preferable to satisfy the suggested composition range.

The rod includes the intersecting twins as a microstructure, and has nano grains. The intersecting twins include fine twins formed inside the intersecting twin lines. Specifically, the intersecting twins are formed of the primary twin, and the secondary fine twin is formed inside the intersecting twin lines. When the intersecting twins occur, the grain refinement effect becomes greater. Because, at the cryogenic temperature, the twins become more active, the additional twins are formed. Thus, the microstructure becomes finer due to the additional twins formed inside the intersecting twin lines.

The average size of the nano grain due to the twins may be 30 to 150 nm, preferably, 50 to 100 nm. The high activation of these twins maximizes the effect of the grain refinement, enabling ultrahigh strength of the rod. In particular, the reason for the formation of the intersecting twins is that the rod is subjected to the rolling process into the rod such that the multi-axial deformation is applied, resulting in the intersecting twins.

In this manner, the rod having the intersecting twins as the microstructure has the FCC single-phase structure without a phase transformation of martensite. That is, in the rod according to the present disclosure, only the twins may occur without generating the martensite, the high hydrogen embrittlement resistance may be obtained despite the ultra-high strength thereof.

In accordance with the present disclosure, although the twin line acts as a diffusible hydrogen trapping region, the rod exhibits the excellent hydrogen delayed fracture resistance because the twin lines have much higher capacity to withstand the fracture than the grain boundaries have. In other words, the hydrogen embrittlement may be suppressed due to the high fracture resistance of the twin line itself.

In addition, the low lattice diffusion characteristics of the FCC structure results in an effect of improving the hydrogen delayed fracture resistance. Further, in the high-entropy alloy according to the disclosure, elements of different sizes are combined with each other such that the lattices are severely distorted. The distortion may further suppress the diffusion of hydrogen, such that the remarkably good hydrogen delayed fracture resistance may be achieved in the rod as the high-entropy alloy according to the present disclosure.

Further, the rod as the high-entropy alloy according to the present disclosure has superior ductility at the cryogenic temperatures rather than at the room temperature, which is not the case in the general alloy. Thus, the rod according to the present disclosure is expected to withstand large deformations in the cryogenic temperature rolling into the rod without cracking and fracture.

The twin is more activated at the cryogenic temperature. Thus, the rod as the high-entropy alloy is preferably produced using the rolling into the rod at a cryogenic temperature of −100 to −200° C.

In FIG. 10A to FIG. 15B, a RTCR rod is obtained by heat-treating and homogenizing an initial alloy material having a composition of $Co_{21.02}Cr_{18.54}Fe_{9.92}Mn_{19.59}Ni_{20.93}$ at 1100° C. for 24 hours and then rolling the heat treated material into a rod at 25° C. at a rolling condition: area reduction of 64%, 11 passes, and a strain of 1. The CTCR rod is obtained by heat-treating and homogenizing an initial alloy material having a composition of $Co_{21.02}Cr_{18.54}Fe_{9.92}Mn_{19.59}Ni_{20.93}$ at 1100° C. for 24 hours and then rolling the heat treated material into a rod at −196.15° C. at a rolling condition: area reduction of 64%, 11 passes, and a strain of 1. TM steel (SCM440) rod has a composition of $FeC_{0.36}Mo_{0.19}Cr_{0.99}Mn_{0.87}$ and the tensile strength thereof is 1470MPa and a total elongation thereof is 9.5%.

Evaluation of tensile properties, measurement of the microstructure, and measurement of the TEM sample, and the crystal structure are the same as the analysis methods of FIG. 2A to FIG. 9.

FIG. 10 shows a microstructure of a produced rod. FIG. 10A shows a EBSD band contrast map picture of a RTCR rod. FIG. 10B shows a EBSD band contrast map picture of a CTCR rod (b). FIG. 10C shows a TEM bright field image (BF) of the CTCR rod.

It may be seen from FIG. 10A that the RTCR rod had intersecting twin lines, but the microstructures had a non-uniform size. It may be observed from FIG. 10B that the CTCR rod had the twins similar to those of the RTCR rod, However, it may be observed from FIG. 10B that there are substantially more twins in the CTCR rod than in the RTCR rod.

Therefore, the CTCR rod had the maximized twin formation at the cryogenic temperature, compared to the room temperature. This increased the segmentation of microstructure. It may be observed that the secondary fine twin is formed inside the intersecting twin lines, such that the grain is further refined. Referring to FIG. 10C, it may be seen based on the diffraction pattern that different twin variants among a total of 12 twin variants are activated in order to form the intersecting twins.

When producing the rod using the multi-pass caliber roller, the intersecting twins may be formed as the compressive stress may be applied in all directions of the circular array. Further, due to the high twin activation at the cryogenic temperature rolling, additional twins may be formed inside the intersecting twins. As a result, the microstructure produced using the cryogenic temperature multi-pass caliber roller has nano grains of approximately 30 to 150 nm in size.

The microstructure size of the rod was calculated using the intercept method.

FIG. 11 shows results of elongation and tensile strength of each of an initial alloy material, RTCR rod, CTCR rod, TM steel rod as a conventional ultrahigh strength commercial material, and pearlitic steel rod as a conventional ultrahigh strength commercial material.

Referring to FIG. 11, it shows that the tensile strength of the CTCR rod is significantly increased compared to the RTCR rod, the TM steel rod as a conventional ultrahigh strength commercial material, and the pearlitic steel rod as a conventional ultrahigh strength commercial material. The cryogenic temperature rolling process into the rod increased the tensile strength of the initial alloy material by up to 230%, such that the tensile strength of the CTCR rod showed a remarkably high value of 1700 MPa or greater. In addition, the CTCR rod showed adequate break elongation of 10% or greater. These results prove that lowering the deformation temperature of the rod to −196.15° C. is remarkably effective in improving the strength thereof.

Therefore, the CTCR rod has a tensile strength of 1700 MPa or greater and an elongation of 10% or greater at the room temperature (25±5° C.).

FIG. 12 shows the results showing the true stress based on the true strain of the CTCR rod and the compressed sample thereof. The true strain refers to a cumulative strain during deformation, and is calculated as ln(initial specimen cross sectional area/post-deformation cross sectional area). The true stress refers to a stress based on an actual cross sectional area resulting from the deformation, and is calculate as (1+strain)×F (applied load applied)/$A_0$ (initial cross sectional area).

A compression test was conducted at a deformation rate of 0.01/s. The test was stopped at a test equipment limit of 80 kN. An inset shows a LD sample when the CTCR material is compressed in a longitudinal direction, and a RD sample when the CTCR material is compressed in a vertical direction.

Referring to FIG. 12, the CTCR rod exhibited a true stress of 1500 MPa or higher without cracking at the low strain of 1.2 or smaller. It may be seen that the LD sample has a high true stress of 1700 MPa or greater and thus has excellent strength and compression elongation. From these results, it may be identified that workability of the CTCR rod in a subsequent step is excellent. The workability in the subsequent step includes tube drawing for tube manufacturing and cold heading for bolt manufacturing.

The TM steel as an ultrahigh strength commercial material requires spheroidizing heat treatment that takes about 20 hours or greater to improve the workability in the subsequent step such as a cold heading step. The spheroidizing heat treatment causes a product cost to rise up and lowers the strength of the material. When no spheroidizing heat treatment is performed, defects occur in the material in the subsequent step, or decrease a die lifespan of a working machine, which increases the production cost.

However, the CTCR material according to the present disclosure has excellent workability in the subsequent step. Accordingly, the CTCR material may be workable without cracking even when forging at room temperature without performing an intermediate heat treatment. Thus, the CTCR material has excellent workability.

Therefore, the CTCR material according to the present disclosure may exhibit the ultrahigh strength at low strain. The production cost thereof may be reduced and the reliability of a produced part may be increased.

The properties of the rod in accordance with the present disclosure were measured using a notched specimen. The notched specimen refers to a cross section in FIG. 13.

FIG. 14 shows results of notch fracture stress based on diffusible hydrogen contents after notching each of a CTCR rod, a TM steel rod as a conventional ultrahigh strength commercial material, and a pearlitic steel rod as a conventional ultrahigh strength commercial material. The notch fracture stress was measured using a slow strain tensile test (SSRT) under conditions of a stroke speed of 0.005 mm/min.

The CTCR rod showed little decrease in the notch fracture stress even as the hydrogen content increased. For example, the notch fracture stress at 0 ppm of the hydrogen content before hydrogen charging was 1960 MPa. The notch fracture stress at 7.8 ppm thereof with the highest hydrogen content was 1831 MPa. It may be seen that the notch fracture stress at the approximately 7.8 ppm thereof decreases by only 6.6%, compared to the notch fracture stress at 0 ppm thereof.

Therefore, the notch fracture stress of the rod according to the present disclosure at the hydrogen content of 8 ppm or smaller deceases, by 10% or smaller, compared to the notch fracture stress of the rod according to the present disclosure at the hydrogen content of 0 ppm.

These results demonstrate the excellent hydrogen delayed fracture resistance of the CTCR rod. To the contrary, when using the two commercial materials, as the hydrogen content inside the rod increases, the notch fracture stress tends to decrease rapidly. Even when the notch fracture stress at the hydrogen content of 2 ppm is rapidly reduced, by 50% or greater, compared to that at the 0 ppm condition before the hydrogen charging. This is because the microstructure defects present in the two commercial materials deteriorate the resistance of the hydrogen delayed fracture.

Therefore, because the notch fracture stress of the rod according to the present disclosure at the hydrogen content of 7.8 ppm deceases, only by 6.6%, compared to the notch fracture stress of the rod according to the present disclosure at the hydrogen content of 0 ppm, the CTCR rod exhibits the excellent hydrogen delayed fracture resistance.

FIG. 15A shows an observation result of a fracture surface when a slow strain tensile test is performed on a specimen of a CTCR rod which is notched and then into which hydrogen is injected at a current density of 10 $Am^{-2}$ for 24 hours at 96.85° C. in 3% NaCl+0.3% $NH_4SCN$ aqueous solution. FIG. 15B shows an observation result of a fracture surface when a slow strain tensile test is performed on a specimen of a TM steel rod which is notched and then into which hydrogen is injected at a current density of 70 $Am^{-2}$ for 48 hours at 25° C. in 0.1 M NaOH aqueous solution.

In the CTCR rod, a quasi cleavage occurs to a depth of 150 μm from a surface thereof. A ductile dimple fracture occurs in a remaining region of the CTCR rod. These results imply that the hydrogen embrittlement occurred locally only on the surface of the CTCR rod because the hydrogens did not penetrate to the inside of the CTCR rod and was concentrated and trapped on the rod surface.

To identify this implication, the TDS analysis in FIG. 16A and FIG. 16B was performed.

FIG. 16A and FIG. 16B shows results of thermal desorption spectroscopy (TDS) analysis after hydrogen is injected into a CTCR rod (left) and a TM steel rod (right) under the same condition.

The TDS analysis employed quadrupole mass spectrometry (Q-mass). To compare the hydrogen storage capacities of the two rods with each other, the hydrogen was charged thereto under the same conditions (current density of 10 $Am^{-2}$ at 25° C. for 24 hours in 3% NaCl+0.3% $NH_4SCN$ aqueous solution) before the TDS analysis.

In addition, after removing a surface portion of the specimen having injected hydrogen therein by about 1 mm, the TDS analysis was performed.

As shown in FIG. 16A, before/after removing 1 mm of the surface portion after filling the hydrogen into the CTCR rod having a diameter of 6 mm, the TDS analysis was performed. It may be identified that, after removing 1 mm of the surface portion, the hydrogen peak of the specimen disappeared. This result supports that most of the hydrogens are concentrated and charged at a depth of 1 mm from the surface. Further, it is determined based on the result of the TDS peak that the twin line acts as a diffusible hydrogen trapping region.

To the contrary, as in FIG. 16B, the TM steel rod as a conventional ultrahigh strength commercial material of a diameter of 6 mm exhibits the quasi cleavage or intergranular fracture surface, which indicates that the hydrogen embrittlement fracture has occurred throughout the rod. It may be seen from this result that the diffusible hydrogen penetrates into the rod and is stored therein.

Both of the CTCR rod and the TM steel rod as a conventional ultrahigh strength commercial material have similar hydrogen desorption temperature range (100 to 200° C.). However, the CTCR rod shows higher hydrogen storage capacity than that of the TM steel rod. This characteristic may be identified in a following Table 3 which shows quantitative hydrogen content results.

TABLE 3

| Material | As-charged | Surface-removed |
|---|---|---|
| CTCRed | 3.5 | 0.2 |
| TM steel | 1.7 | 1.3 |

The reason why the hydrogen embrittlement resistance is excellent although a large amount of hydrogen is injected into the rod and the hydrogens are stored in the twin line acting as the diffusible hydrogen trapping region, is that the twin line acting as the main cracking site has a high resistance to the fracture.

Further, the movement of hydrogen may be difficult inside the material. Thus, even when the hydrogen is easily deviated from the twin line, the local concentration of hydrogen may be suppressed. Accordingly, in accordance with the present disclosure, the grains are refined using the twin line with the high hydrogen embrittlement resistance, and thus the ultrahigh strength characteristics are exhibited.

To the contrary, in the conventional ultrahigh strength commercial material such as the TM steel, grains are refined via the formation of martensite grain boundaries. However, the hydrogen embrittlement is promoted because these grain boundaries are susceptible to fracture.

As described above, in accordance with the present disclosure, the ultrahigh strength rod free of the hydrogen embrittlement may be produced using the high-entropy alloy having a microstructure at the low strain without the severe plastic deformation.

The ultrahigh-strength rod according to the present disclosure exhibits ultrahigh strength properties by the line of intersecting twins as the microstructure effectively refining the grains. In addition, the ultrahigh strength rod according to the present disclosure has an effect of improving the durability and stability due to improved hydrogen delayed fracture resistance.

Further, the rod exhibits the ultrahigh strength characteristics. Thus, it is possible to reduce a diameter of all types of the rods and a diameter of a part irrespective of a shape.

In addition, the ultrahigh strength characteristic of the rod enables material saving and light weight. Thus, the ultrahigh-strength rod according to the present disclosure may be applied as various materials in other technical fields that require both of the ultrahigh strength and the hydrogen delayed fracture resistance.

Although the embodiments of the present disclosure have been described above with reference to the accompanying drawings, the present disclosure is not limited to the embodiments, but may be realized in various different forms. Those skilled in the art to which the present disclosure belongs may understand that the present disclosure may be implemented in other specific forms without changing the technical idea or essential characteristics of the present disclosure. Therefore, the embodiments as described above are illustrative in all aspects and should be understood as non-limiting.

What is claimed is:

1. A method for producing a high-entropy alloy, the method comprising:

(a) annealing and homogenizing an initial alloy material at 1000 to 1200° C. for 1 to 24 hours; and (b) rolling the annealed and homogenized initial alloy material into a cylindrical rod, thereby to produce a high-entropy alloy having intersecting twins as a microstructure, and secondary fine twins formed in the intersecting twins, wherein the initial alloy material contains Co of 5 to 35%, Cr of 5 to 35%, Fe of 5 to 35%, Mn of 5 to 35%, and Ni of 5 to 35%, based on weight %, and wherein the rolling into the cylindrical rod is performed with a multi-pass caliber-roller having circular holes of different diameters at a cryogenic temperature of −100 to −200° C. in multi-axial directions.

2. The method of claim 1, wherein the rolling into the cylindrical rod is performed at a strain of 0.4 to 1.2.

3. The method of claim 1, wherein the (b) includes:

(b1) forming primary twins as the intersecting twins; and (b2) forming the secondary fine twins inside a line of the intersecting twins.

4. The method of claim 1, wherein an average size of a fine grain due to the intersecting twins and the secondary fine twins is in a range of 30 to 150 nm.

5. The method of claim 1, wherein the high-entropy alloy has a FCC (face-centered cubic) single-phase structure.

* * * * *